US006018940A

United States Patent [19]

Seibert

[11] Patent Number: 6,018,940

[45] Date of Patent: Feb. 1, 2000

[54] DEVICE FOR PRODUCING CABLE STRANDING

[76] Inventor: Gerhard Seibert, Am Flachhard 3, A-2500 Baden, Austria

[21] Appl. No.: 09/023,704

[22] Filed: Feb. 13, 1998

[51] Int. Cl.[7] ..... D01H 5/00

[52] U.S. Cl. ..... 57/293; 57/99; 57/294

[58] Field of Search ..... 57/293, 294, 99

[56] References Cited

U.S. PATENT DOCUMENTS 3,133,402 5/1964 Zwolinski et al. ..... 57/34
4,325,214 4/1982 Zuber ..... 57/293
4,414,802 11/1983 Garner et al. ..... 57/293
5,799,477 9/1998 Seibert ..... 57/293

*Primary Examiner*—William Strylewski
*Attorney, Agent, or Firm*—Young & Thompson

[57] ABSTRACT

A device for producing cable stranding from stranding elements (1) with changing direction of lay between stranding pulley (3) driven with alternating direction of rotation and stationary inlet pulley (5) on the wire inlet side with holes (8) to hold individual wires (1) to be stranded has several storage pulleys (4) likewise provided with holes (8). Storage pulleys (4) are pivotally mounted in machine frame (17). There is one drive (6) only for stranding pulley (3) and there is torsionally elastic connection (7,9,11,14,16) between stranding pulley (3) and storage pulleys (4), via which storage pulleys (4) are driven.

13 Claims, 4 Drawing Sheets

DEVICE FOR PRODUCING CABLE STRANDING

BACKGROUND OF THE INVENTION

The invention relates to a device for producing cable stranding from stranding elements with changing direction of lay, between a stranding pulley driven with alternating direction of rotation and a stationary inlet pulley on the wire inlet side with holes to hold the individual wires to be stranded there being several pivotally mounted storage pulleys likewise provided with holes.

For known generic devices The pivotally mounted storage pulleys are driven via rigid intermediate shafts with different multiplications. The respective multiplication, therefore the rpm of the individual storage pulley, depends on the lengthwise position in the storage segment. The disadvantage arises from relatively large masses to be accelerated when the direction of rotation changes. In this way the turning points in the produced strand become undesirably long or therefore the working speeds must be limited.

EP 0 582 802 A1 and EP 0 031 081 A1 disclose means in which the storage pulleys are attached to one or more tensioned support elements with good tensile strength, for example, stranded cables. In this way the mass inertia can be kept small; for this reason however rpm-dependent transverse oscillations (resonances) of the entire twist storage take place so that high performance or high rpm are difficult to achieve.

SUMMARY OF THE INVENTION

The object of the invention is therefore to develop a device of the initially mentioned type such that the disadvantages of the prior art are avoided as much as possible.

This is done in a generic device by there being one drive only for the stranding pulley and by a torsionally elastic connection between the stranding pulley and storage pulleys, via which the storage pulleys are driven.

Since in this inventor only the stranding pulley is driven, the considerable frictional and inertial forces of the drives for the storage pulleys can be avoided. The pivotal mounting of the individual storage pulleys prevent the entire stranding segment from starting to oscillate, as is the case in the devices as per EP 0 582 802 A1 and EP 0 031 081 A1. In addition there is another advantage over these devices in that the torsionally elastic connection need not bear the entire stranding section with the storage pulleys and thus it need only accommodate much lower tensile forces, and as a result with respect to its torsion and bending behavior can be optimally dimensioned. The torsionally elastic connection can therefore be optimally formed according to the necessary bending or torsion behavior without having to consider its bearing capacity in particular. In this way the stranding machine as claimed in the invention can be optimally adapted to the given application.

Although the storage pulleys by their bearing are loaded with additional friction and inertial forces, it has been shown that very high or even higher rpm than with the devices described in EP 0 582 802 A1 and EP 0 031 081 A1 are possible, since the aforementioned disadvantage with respect to higher frictional and mass forces can be more than balanced by a better configuration of the torsionally elastic connection, since the rotary-elastic connection no longer need have a bearing function for the storage pulleys.

For example, as claimed in this invention, for small strand dimensions which should have very short turning points at very high working speeds, the invention can be configured such that the torsionally elastic connection is a central elastic element, preferably of plastic, which is joined torsionally strong to the stranding pulley and the storage pulleys and is seated rigidly in the stationary guide on the wire inlet side, or that the central elastic element is a helical spring. In this embodiment a torsion shaft with high energy storage capacity can be produced to support the drive motor for the stranding pulley during braking and acceleration.

For slow running machines for larger cable dimensions this is less important, for which the torsion connection must often be made such that it can also drive many, many storage pulleys so that the finished stranded material can be made with many twists in succession in one direction of rotation.

In these cases embodiments of the invention which are made as defined for example in claims 5, 6 and 7 have proven effective.

BRIEF DESCRIPTION OF THE DRAWINGS

Other features and advantages of the invention follow from the other subclaims and following description of embodiments of the invention with reference to the drawings.

DESCRIPTION OF THE PREFERRED EMBODIMENT

Figure 1:
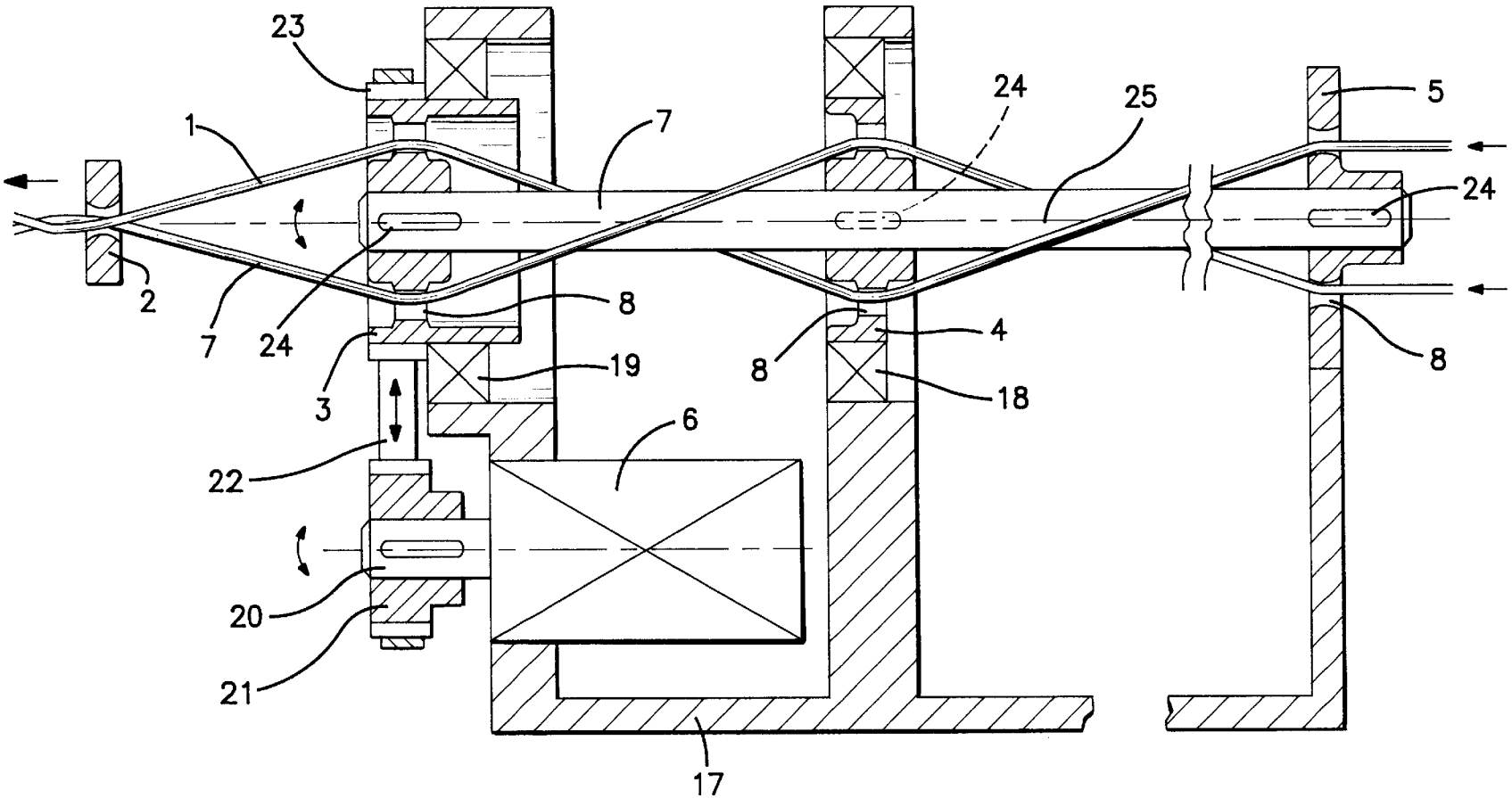
FIG. 1 schematically shows a first embodiment of a device as claimed in the invention with a torsionally elastic connection in the form of a rod-shaped element.

FIG. 1 schematically shows a stranding machine as claimed in the invention in which on machine frame 17 rigid inlet pulley 5, several storage pulleys 4 pivotally mounted in bearings 18 (only one is shown), and stranding pulley 3 pivotally mounted in bearing 19 are supported. Stranding pulley 3 is driven using electric motor 6 via pinion 21 pivotally mounted torsionally strong on shaft 20 of electric motor 6 and toothed belt 22 which fits into a toothed ring 23 located on the outer periphery of stranding pulley 3.

The rotary motion of stranding pulley 3 driven with alternating direction of rotation is transferred to storage pulleys 4 using a torsionally elastic connection in the form of rod-shaped element 7. Rod-shaped element 7 which lies in the axis of rotation 25 of stranding pulley 3 and storage pulleys 4 is joined torsionally strong for example via keys 24 to stranding pulley 3, storage pulleys 4 and inlet pulley 5. Since stranding pulley 3, is driven with an alternating direction of rotation and inlet pulley 5, is rigid, rod-shaped element 7 is turned alternately in one and the other direction, the angle of rotation of individual storage pulleys 4 increasing from inlet pulley 5 to stranding pulley 3.

If central stranding element 10 (FIG. 2) is to be stranded at the same time, rod-shaped element 7 can of course also be made hollow. Element 7 need not, as shown in FIG. 1, be made in one piece over the entire stranding segment, but can also be composed of several individual parts.

Figure 3:
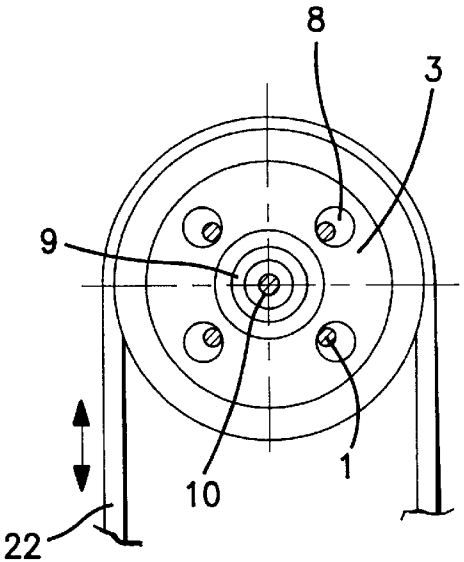
FIG. 3 shows a side view of FIG. 2.

Stranded material 1 is, as shown in FIG. 3, for example, guided through holes 8 in inlet pulley 5, storage pulleys 4 and stranding pulley 3 and then guided through stranding nipple 2, after which a plastic casing for example is extruded onto the stranding.

The number of holes 8 in pulleys 3, 4, 5 depends on the number of stranding elements 1 to be stranded at the time.

Figure 2:
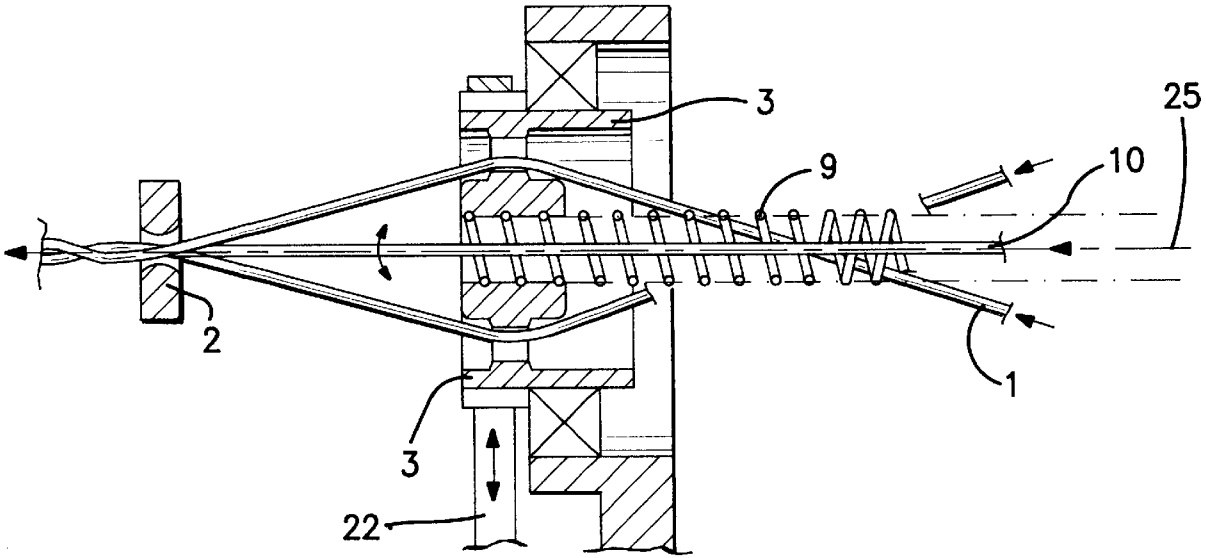
FIG. 2 shows a second embodiment of a torsionally elastic connection in the form of a helical spring.

FIG. 2 shows one alternative embodiment of a torsionally strong connection in the form of helical spring 9 by which central stranding element 10 is guided. Stranding pulley 3 and storage pulleys 4 are connected torsionally strong to helical spring 9. The remaining structure of the stranding machine corresponds essentially to the one shown in FIG. 1, the rotary motion being transferred from stranding pulley 3 to storage pulleys 4 however by means of helical spring 9 which will generally have a less steep spring core line of torsion as rod-shaped, torsionally elastic connection 7 from FIG. 1.

Figure 4:
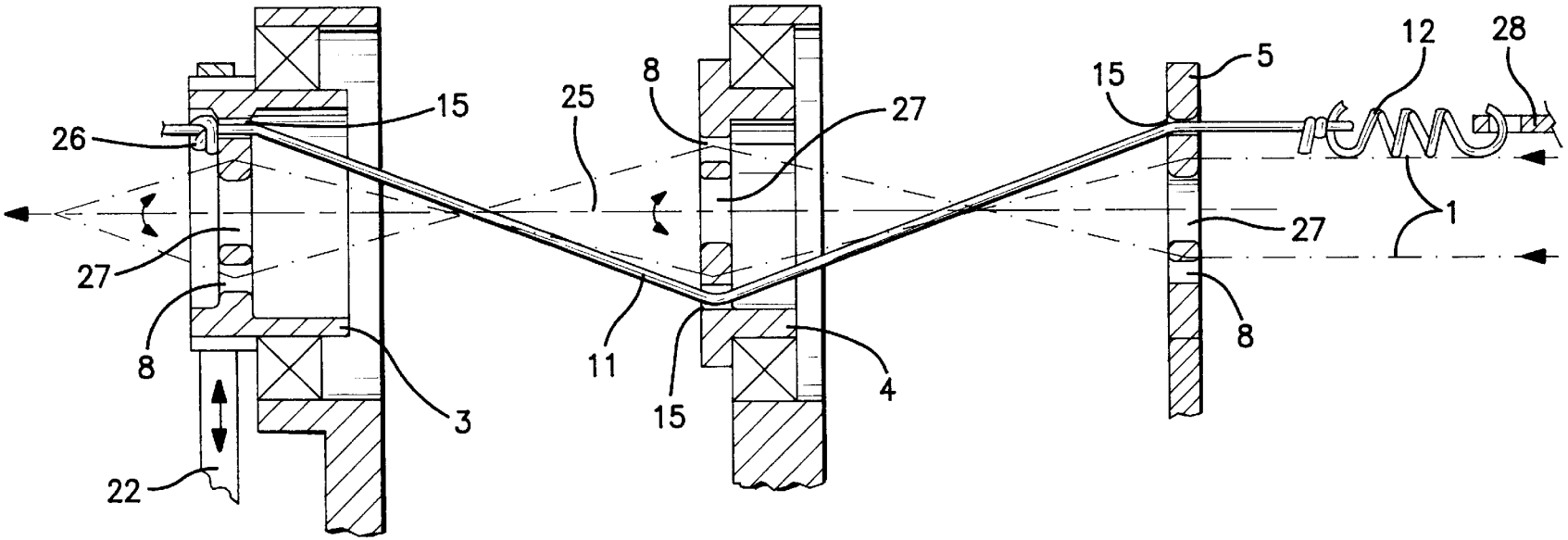
FIG. 4 shows another embodiment of a torsionally elastic connection in the form of an eccentrically guided stranded cable.

In the embodiment shown in FIG. 4 the torsionally elastic connection is made in the form of stranded cable 11 which is guided eccentrically to axis of rotation 25 of pulleys 3, 4 through holes 15 in pulleys 3, 4, 5. Stranded cable 11 is rigidly attached to stranding pulley 3, for example, by means of knot 26, conversely in the region of inlet pulley 5 (viewed in the stranding direction in front of inlet pulley 5) it is attached or prestressed by means of tension spring 12 to stationary abutment 28.

Figure 5:
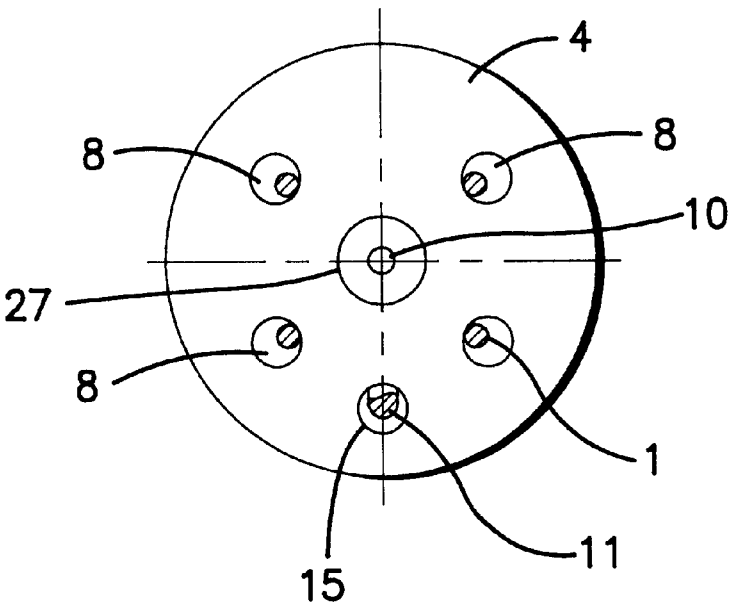
FIG. 5 shows a side view of FIG. 4.

As can be seen in FIG. 5, storage pulleys 4 in the embodiment shown in FIG. 4 have for example four holes 8 distributed regularly in the peripheral direction for stranding elements 1, and central hole 27 for central stranding element 10. Furthermore there is hole 15 for the torsionally elastic connection in the form of stranded cable 11 eccentrically on stranding pulley 4.

Figure 7:
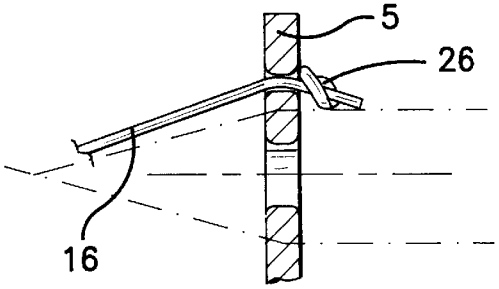
FIG. 6 shows a view in the axial direction to a storage pulley with eccentrically guided torsion belt and FIG. 7 shows one alternative embodiment to FIG. 4, in which the stranded cable is tensioned, not by spring force, but under its own tension.

FIG. 7 shows, as an alternative to the attachment of stranded cable 11 shown in FIG. 4, on inlet pulley 5 there is likewise knot 26 so that stranded cable 16 is not tensioned by the force of one spring 12, but by its inner tensile stress.

Figure 6:
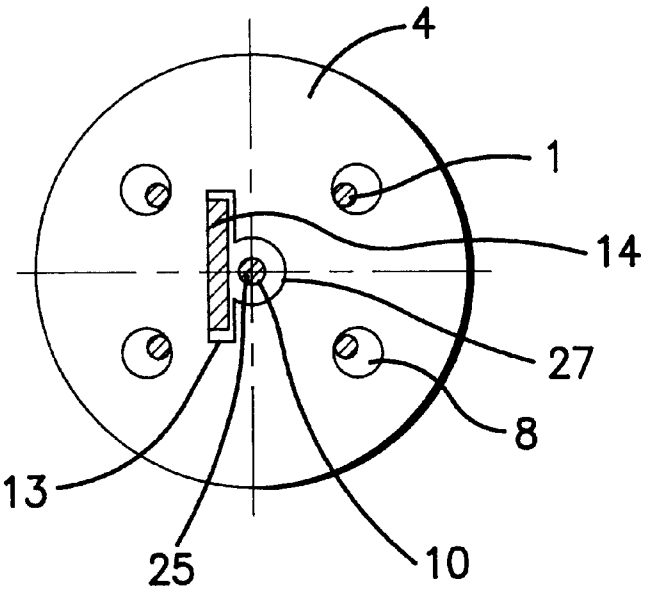

Finally, FIG. 6 shows an embodiment in which the torsionally elastic connection is made in the form of torsion belt 14 which is guided by recess 13 which is made accordingly slotted or rectangular in storage pulleys 4 and by inlet pulley 5 and stranding pulley. Torsion belt 14 is held likewise under tensile stress in a manner not shown in the drawings.

As is shown in FIG. 6, recess 13 is located off-center to axis of rotation 25 of stranding pulley 4 so that stranding element 10 can be guided through central hole 27. If there is no need for central stranding element 10, recess 13 or torsion belt 14 can of course also be guided centrally by pulleys 3, 4, 5.

Eccentrically guided, torsionally elastic connections as are shown in FIGS. 4 through 7 have the advantage that the rotary forces are applied to storage pulleys 4 supported not only by the torsion forces of this connection, but also by the tensile forces and bending forces of the connection, in which it should always be ensured that the difference of the angles of rotation of two adjacent storage pulleys do not exceed 180° or do so only little, since the tensile force in stranding elements 1 for overly large difference angles can increase so much that this leads to rupture of stranding element 1.

I claim:

1. A device for producing a stranded cable from stranding elements that change directions of lay, the device comprising:

an inlet pulley with first holes for receiving individual stranding elements that form a stranded cable, said inlet pulley being non-rotatably mounted on a stationary frame;

at least one storage pulley with second holes for receiving the individual stranding elements from said inlet pulley, said storage pulley being rotatably mounted on the stationary frame;

a stranding pulley with third holes for receiving the individual stranding elements from said at least one storage pulley, said stranding pulley being rotatably mounted on the stationary frame;

a motor rotating said stranding pulley in alternating directions; and a torsionally elastic connection that is torsionally connected to said stranding pulley and to said at least one storage pulley for rotating said at least one storage pulley, said torsionally elastic connection extending through a fourth hole in said at least one storage pulley.

2. The device of claim 1, wherein said torsionally elastic connection is non-rotatably attached to said stationary inlet pulley.

3. The device of claim 1, wherein said torsionally elastic connection comprises a helical spring.

4. The device of claim 1, wherein said inlet, storage, and stranding pulleys have a common axis of rotation, and wherein said fourth hole is eccentric to said common axis of rotation.

5. The device of claim 4, wherein said torsionally elastic connection is connected to said stranding pulley and to said inlet pulley eccentric to said common axis of rotation.

6. The device of claim 1, wherein said torsionally elastic connection is hollow.

7. The device of claim 1, wherein said torsionally elastic connection comprises an elastic belt, and said fourth hole is a slot having a cross-section corresponding to said belt.

8. The device of claim 7, wherein said belt is non-rotatably attached to said inlet pulley and extends into a further slot in said stranding pulley that has a cross-section corresponding to said belt.

9. The device of claim 1, wherein said torsionally elastic connection comprises an element that is lengthwise elastic, and wherein said element is attached to said inlet pulley and said stranding pulley under tensile stress.

10. The device of claim 9, wherein said inlet, storage, and stranding pulleys have a common axis of rotation, and wherein said fourth hole is eccentric to said common axis of rotation.

11. The device of claim 10, wherein said element is attached to said stranding pulley and to said inlet pulley eccentric to said common axis of rotation.

12. The device of claim 1, wherein said torsionally elastic connection comprises an element that is lengthwise elastic, and wherein said element is held between said inlet pulley and said stranding pulley under tensile stress with one of a spring and a hydraulic cylinder.

13. The device of claim 12, wherein said inlet, storage, and stranding pulleys have a common axis of rotation, and wherein said element is held at said inlet and stranding pulleys eccentric to said common axis of rotation.

* * * * *